US009096403B2

(12) United States Patent
Takano et al.

(10) Patent No.: US 9,096,403 B2
(45) **Date of Patent: *Aug. 4, 2015**

(54) SHEET STACKING APPARATUS, IMAGE FORMING SYSTEM AND SHEET STACKING METHOD

(71) Applicants: Satoru Takano, Kanagawa (JP); Kiichiro Goto, Kanagawa (JP); Takashi Fukumoto, Kanagawa (JP); Yasuo Niikura, Kanagawa (JP); Shintaro Matsumoto, Kanagawa (JP); Hidetoshi Kojima, Kanagawa (JP); Kei Sasaki, Kanagawa (JP); Junya Suzuki, Kanagawa (JP); Kazunori Konno, Kanagawa (JP); Yuuta Mori, Kanagawa (JP); Kohjiroh Haga, Kanagawa (JP); Yasushi Tsuruoka, Kanagawa (JP); Takamasa Matsumoto, Kanagawa (JP); Ryo Takahashi, Kanagawa (JP); Youhei Niitsuma, Kanagawa (JP)

(72) Inventors: Satoru Takano, Kanagawa (JP); Kiichiro Goto, Kanagawa (JP); Takashi Fukumoto, Kanagawa (JP); Yasuo Niikura, Kanagawa (JP); Shintaro Matsumoto, Kanagawa (JP); Hidetoshi Kojima, Kanagawa (JP); Kei Sasaki, Kanagawa (JP); Junya Suzuki, Kanagawa (JP); Kazunori Konno, Kanagawa (JP); Yuuta Mori, Kanagawa (JP); Kohjiroh Haga, Kanagawa (JP); Yasushi Tsuruoka, Kanagawa (JP); Takamasa Matsumoto, Kanagawa (JP); Ryo Takahashi, Kanagawa (JP); Youhei Niitsuma, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/078,707

(22) Filed: Nov. 13, 2013

(65) Prior Publication Data

US 2014/0145395 A1 May 29, 2014

(30) Foreign Application Priority Data

Nov. 28, 2012 (JP) ..... 2012-260181

(51) Int. Cl.

| | |
|---|---|
| ***B65H 29/24*** | (2006.01) |
| ***B65H 31/26*** | (2006.01) |
| ***G03G 15/00*** | (2006.01) |

(52) U.S. Cl.

CPC ..... *B65H 29/246* (2013.01); *B65H 31/26* (2013.01); *G03G 15/6552* (2013.01); *B65H 2406/1211* (2013.01); *B65H 2511/10* (2013.01); *B65H 2511/416* (2013.01); *B65H 2515/212* (2013.01);

(Continued)

(58) Field of Classification Search

CPC ..... B65H 29/245; B65H 29/24566; B65H 29/246

USPC ..... 271/211

See application file for complete search history.

(56) References Cited

U.S. PATENT DOCUMENTS

| | | | | |
|---|---|---|---|---|
| 3,502,407 | A * | 3/1970 | Ellis et al. | 399/335 |
| 5,324,024 | A * | 6/1994 | Mori | 271/296 |
| 5,460,361 | A * | 10/1995 | Mokler | 271/183 |

(Continued)

FOREIGN PATENT DOCUMENTS

| | | |
|---|---|---|
| JP | H04-107745 U | 9/1992 |
| JP | 09-240898 | 9/1997 |

(Continued)

*Primary Examiner* — Michael McCullough

(74) *Attorney, Agent, or Firm* — Harness, Dickey & Pierce, P.L.C.

(57) ABSTRACT

A sheet stacking apparatus including: a discharge unit configured to discharge a sheet through a discharge port; a stack unit configured to stack the discharged sheet thereon; and a plurality of blowing units configured to supply air to a discharge side of the discharge unit while the sheet is discharged, wherein the blowing units are disposed, below the discharge port, aligned with a direction perpendicular to a sheet discharge direction.

19 Claims, 15 Drawing Sheets

(52) U.S. Cl.
CPC ..... *B65H 2601/273* (2013.01); *B65H 2801/27* (2013.01)

(56) References Cited

U.S. PATENT DOCUMENTS

| | | | | |
|---|---|---|---|---|
| 5,855,367 | A | 1/1999 | Inoue et al. | |
| 6,522,841 | B2 * | 2/2003 | Horikoshi | 399/45 |
| 6,962,334 | B2 * | 11/2005 | Erkelenz | 271/183 |
| 7,017,491 | B2 * | 3/2006 | Edamitsu | 101/477 |
| 7,661,671 | B2 * | 2/2010 | Yamazaki et al. | 271/211 |
| 2010/0209163 | A1 * | 8/2010 | Suzuki | 399/397 |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2013/0113154 | A1 | 5/2013 | Furuhashi et al. | |
| 2013/0134659 | A1 * | 5/2013 | Konno et al. | 271/176 |
| 2013/0147105 | A1 | 6/2013 | Sugiyama et al. | |
| 2013/0228965 | A1 * | 9/2013 | Hoshino et al. | 271/211 |
| 2013/0236228 | A1 * | 9/2013 | Nagasako et al. | 399/405 |

FOREIGN PATENT DOCUMENTS

| | | | |
|---|---|---|---|
| JP | 2000-153948 | A | 6/2000 |
| JP | 2000-351517 | | 12/2000 |
| JP | 2006-124104 | | 5/2006 |
| JP | 2008-273663 | | 11/2008 |
| JP | 2010-132372 | | 6/2010 |
| JP | 2011-057313 | | 3/2011 |
| JP | 2012-020845 | A | 2/2012 |

* cited by examiner

SHEET STACKING APPARATUS, IMAGE FORMING SYSTEM AND SHEET STACKING METHOD

CROSS-REFERENCE TO RELATED APPLICATIONS

The present application claims priority to and incorporates by reference the entire contents of Japanese Patent Application No. 2012-260181 filed in Japan on Nov. 28, 2012.

BACKGROUND OF THE INVENTION

1. Field of the Invention

The present invention relates to a sheet stacking apparatus, an image forming system, and a sheet stacking method and, particularly, to a sheet stacking apparatus that, upon discharge, aligns and stacks a sheet-like recording medium (in this specification, simply referred to as a "sheet"), such as a conveyed sheet, recording sheet, transfer sheet, or OHP sheet, an image forming system that includes the sheet stacking apparatus and an image forming apparatus, such as a copier, printer, facsimile machine, or digital multifunction peripheral, and a sheet stacking method performed by the sheet stacking apparatus.

2. Description of the Related Art

Conventional sheet handling apparatuses (here, referred to as the "sheet post-handling apparatuses" that perform post handling) have been well known and widely used. The sheet post-handling apparatuses perform post handling, i.e., various operations including alignment, binding, folding, or bookbinding, on sheets discharged from an image forming apparatus. In recent years, there has been a greatly increasing demand for the capability of this type of sheet post-handling apparatus to handle with sheets. Particularly, color image forming apparatuses are more likely to perform printing on sheets (hereafter, referred to as coated sheets) that are coated so as to give improved image appearance for catalogs or leaflets. However, the coated sheets generally have the following characteristics:

1) the degree of smoothness of the surface is high;
2) the adhesion between sheets is high; and
3) the Clark stiffness is low.

Therefore, there is a possibility that the stackability of coated sheets is degraded due to the above characteristics.

There is a well-known apparatus that uses a pressing member to stack discharged sheets at a proper position, whereby the degradation in stackability is prevented. With such an apparatus that uses a pressing member, it is possible to prevent the leading sheet from being pushed out by a subsequent sheet. However, in the case of thin sheets that have low stiffness, the stiffness of sheets is not enough to prevent the adhesion between the sheets, and therefore the sheet is conveyed while the sheet adheres to another sheet. As a result, the sheet is sometimes bent. For example, Japanese Patent Application Laid-open No. 2011-57313 discloses the invention in which a blower fan is provided to form an air layer in the gap between the leading sheet and the subsequent sheet so as to prevent the sheet discharged into the stack unit from adhering to the sheet already stored in the stack unit.

The invention disclosed in Japanese Patent Application Laid-open No. 2011-57313 makes consideration to prevent a degradation in the efficiency of sheet conveyance and discharge by means of the provided blower fan. However, it discloses only the installation of the blower fan. Therefore, although air blowing is effective to prevent the adhesion, there is no assurance that a sufficient air layer is formed which covers the leading end of the discharged sheet. As a result, sheet adhesion and bending occur, and alignment accuracy is degraded.

Therefore, there is a need to ensure that sheet adhesion and bending are prevented and desired alignment accuracy is obtained.

SUMMARY OF THE INVENTION

It is an object of the present invention to at least partially solve the problems in the conventional technology.

According to an aspect of the invention, a sheet stacking apparatus is provided. The sheet stacking apparatus includes: a discharge unit configured to discharge a sheet through a discharge port; a stack unit configured to stack the discharged sheet thereon; and a plurality of blowing units configured to supply air to a discharge side of the discharge unit while the sheet is discharged, wherein the blowing units are disposed, below the discharge port, aligned with a direction perpendicular to a sheet discharge direction.

According to another aspect of the invention, a sheet stacking apparatus is provided. The sheet stacking apparatus includes: a discharge unit configured to discharge a sheet through a discharge port; a stack unit configured to stack the discharged sheet thereon; and a blowing unit configured to supply air toward a lower surface of the sheet that is being discharged, the air being supplied in a direction that is not toward a sheet stack surface of the stack unit.

According to further aspect of the invention, a sheet stacking method is provided. The method includes: discharging, by a discharge unit, a sheet through a discharge port; stacking, on a stack unit, the sheet discharged by the discharge unit; and supplying air to a discharge side while the sheet is discharged by using a plurality of blowing units that is located below the discharge port and is arranged along a direction perpendicular to a sheet discharge direction.

The problems, configurations, and advantages other than those described above are apparent from the following explanation of the embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is characterized in that a plurality of blowing units is provided to supply air to the discharge side while a sheet is discharged, the blowing units are located below a discharge port and are arranged along a direction perpendicular to the sheet discharge direction, and air is supplied to the lower surface of the discharged sheet.

An exemplary embodiment of the present invention is explained in detail below with reference to the accompanying drawings.

Figure 1:
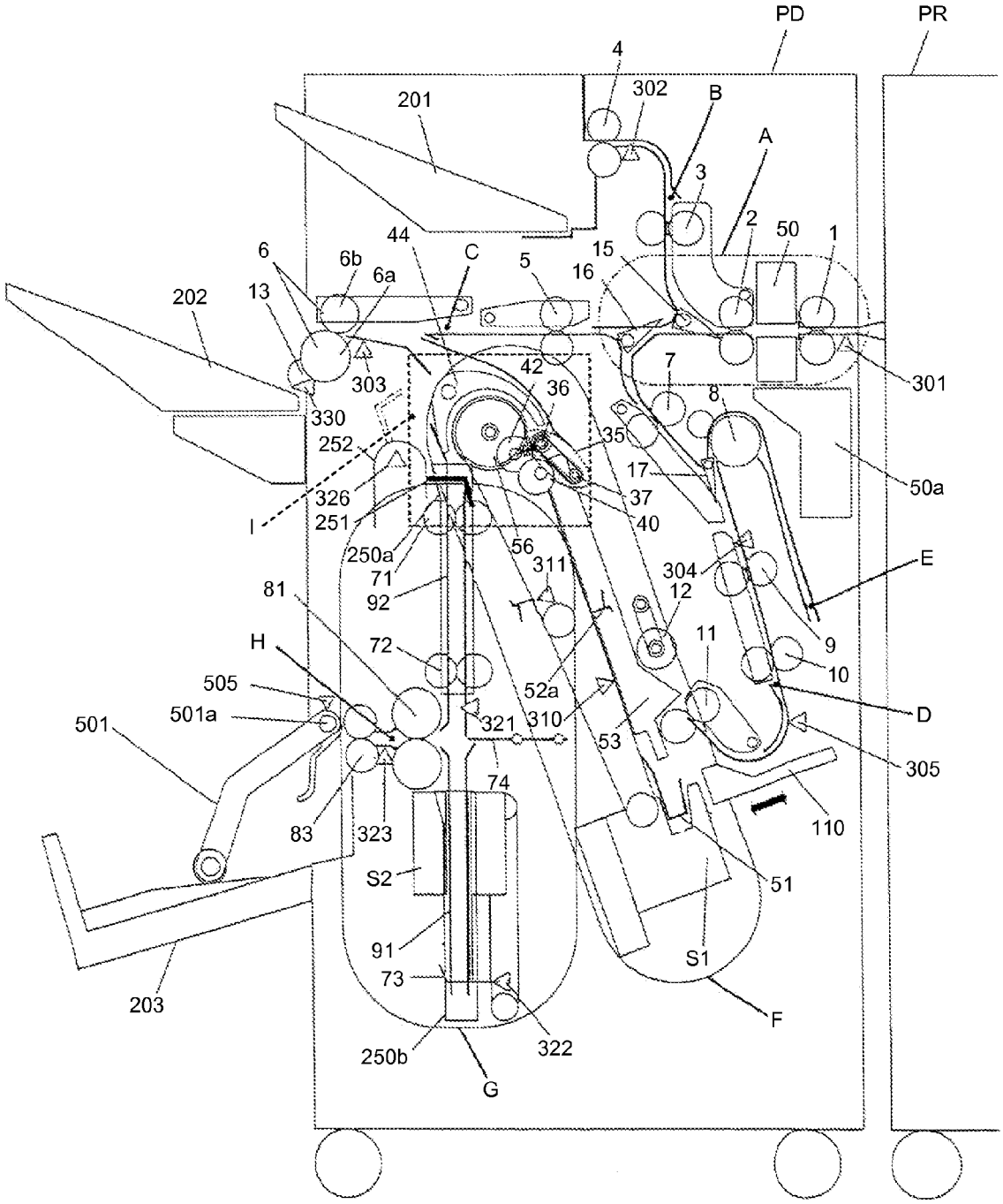
FIG. 1 is a system configuration diagram that illustrates a system that includes a sheet post-handling apparatus including a sheet stacking apparatus according to an embodiment of the present invention and that includes an image forming apparatus.

FIG. 1 is a system configuration diagram that illustrates an image forming system that includes a sheet post-handling apparatus PD that is a sheet handling apparatus according to the present embodiment and includes an image forming apparatus PR.

With reference to FIG. 1, the image forming apparatus PR includes at least an image processing circuit that converts input image data into printable image data; an optical writing device that performs optical writing on a photosensitive element in accordance with an image signal that is output from the image processing circuit; a developing device that develops, by using toner, a latent image that is formed on the photosensitive element due to the optical writing; a transfer device that transfers, onto a sheet, the toner image that is developed by the developing device; and a fixing device that fixes the transferred toner image onto the sheet. After the sheet to which the toner image is fixed is delivered to the sheet post-handling apparatus PD, required post handling is performed by the sheet post-handling apparatus PD. Here, the image forming apparatus PR is an electrophotographic image forming apparatus as described above; however, any well-known image forming apparatuses, such as ink-jet or thermal-transfer image forming apparatuses, may be used. In the present embodiment, the image processing circuit, the optical writing device, the developing device, the transfer device, and the fixing device that are described above constitute an image forming unit.

The sheet post-handling apparatus PD is attached to the side of the image forming apparatus PR, and the sheet discharged from the image forming apparatus PR is delivered to the sheet post-handling apparatus PD. The sheet post-handling apparatus PD includes a conveyance path A, a conveyance path B, a conveyance path C, a conveyance path D, and a conveyance path H. The sheet is first conveyed into the conveyance path A that includes a post-handling unit (a punch unit 50 that is a punch unit in the present embodiment) that performs post handling on each sheet.

The conveyance path B is a conveyance path that leads to an upper tray 201 through the conveyance path A, and the conveyance path C is the conveyance path C that leads to a shift tray 202. The conveyance path D is the conveyance path D that leads to a processing tray F (hereafter, also referred to as the "end-face binding processing tray") that performs alignment, staple binding, and the like. The configuration is such that the sheet is delivered from the conveyance path A to either the conveyance path B, C, or D by a separating claw 15 and a separating claw 16.

In the sheet post-handling apparatus, various operations can be performed on sheets, such as punching (the punch unit 50), sheet alignment and end-binding (a jogger fence 53 and an end-face binding stapler S1), sheet alignment and center-binding (an upper center-binding jogger fence 250*a*, a lower center-binding jogger fence 250*b*, and a center-binding stapler S2), sheet sorting (the shift tray 202), and center-folding (a folding plate 74 and a folding roller 81). Therefore, the conveyance path A and the following conveyance paths B, C, and D are selected depending on an operation. Furthermore, the conveyance path D includes a sheet housing section E, and on the downstream side of the conveyance path D are located the end-face binding processing tray F, a center-binding center-folding processing tray G, and a sheet discharge conveyance path H.

On the conveyance path A that is located upstream of the conveyance path B, the conveyance path C, and the conveyance path D and that is common thereto, an entry sensor 301 is located to detect a sheet received from the image forming apparatus PR, and an entry roller 1, the punch unit 50, a punch waste hopper 50*a*, a conveying roller 2, and the first and second separating claws 15 and 16 are sequentially located downstream of the entry sensor 301. The first and second separating claws 15 and 16 are kept in the state illustrated in FIG. 1 by undepicted springs (the initial states). When undepicted first and second solenoids are turned on, the separating claws 15 and 16 are driven, respectively. When the first and second solenoids are selectively turned on/off, the combination of separation directions of the first and second separating claws 15 and 16 is changed so that a sheet is delivered to either the conveyance path B, the conveyance path C, or the conveyance path D.

If the sheet is to be guided to the conveyance path B, the state illustrated in FIG. 1, i.e., the state where the first solenoid is off (the first separating claw 15 faces downward in the initial state), is kept. Thus, the sheet is delivered from a conveying roller 3 to an upper discharge roller 4 and then discharged into the upper tray 201.

If the sheet is to be guided to the conveyance path C, the first and second solenoids are turned on (the second separating claw 16 faces upward in the initial state) in the state illustrated in FIG. 1 so that a state is obtained such that the separating claw 15 rotates upward and the separating claw 16 rotates downward. Thus, the sheet is conveyed from a discharge port 6*c* (see FIG. 13) toward the shift tray 202 through a conveying roller 5 and a pair of discharge rollers 6 (6*a*, 6*b*). In this case, sheet sorting is conducted. Sheet sorting is performed by the pair of shift discharge rollers 6 (6*a*, 6*b*); a return roller 13; a sheet-surface detection sensor 330; the shift tray 202; an undepicted shift mechanism that moves the shift tray 202 back and forth in a direction perpendicular to the sheet conveying direction; and a shift-tray lifting/lowering mechanism that lifts and lowers the shift tray 202.

If the sheet is to be guided to the conveyance path D, the first solenoid that drives the first separating claw 15 is turned on and the second solenoid that drives the second separating claw is turned off so that a state is obtained such that both the separating claw 15 and the separating claw 16 rotate upward, whereby the sheet is guided from the conveying roller 2 to the conveyance path D via a conveying roller 7. After being guided to the conveyance path D, the sheet is guided to the end-face binding processing tray F. After being subjected to alignment, stapling, and the like, on the end-face binding processing tray F, the sheet is delivered by a guide member 44 to the conveyance path C that leads to the shift tray 202 or the center-binding center-folding processing tray G (hereafter, simply referred to as the "center-binding processing tray") that performs folding, and the like. If the bundle PB of sheets is to be guided to the shift tray 202, the bundle PB of sheets is discharged into the shift tray 202 through the pair of discharge rollers 6. Furthermore, after being guided to the center-binding processing tray G, the bundle PB of sheets is subjected to folding and binding on the center-binding processing tray G and then discharged into a lower tray 203 through a lower discharge roller 83 via the sheet discharge conveyance path H.

Furthermore, a separating claw 17 is provided on the conveyance path D and is kept in the state illustrated in the drawing by an undepicted low-load spring. After the trailing edge of the sheet conveyed by the conveying roller 7 passes through the separating claw 17, at least a conveying roller 9 is rotated in reverse among the conveying rollers 9, 10 and a staple discharge roller 11 so that the sheet can be moved backward along a turn guide 8. Thus, a configuration is such that the sheet can be guided to the sheet housing section E, with the trailing edge thereof first entering, and held there (pre-stacked) so that the sheet can be stacked and conveyed with the subsequent sheet. This operation is repeated so that two or more sheets can be stacked on one another and conveyed. The reference numeral 304 denotes a pre-stack sensor for setting a backward feed timing at which a sheet is to be pre-stacked.

When the sheet is guided to the conveyance path D for sheet alignment and end-binding, the sheet is guided to the end-face binding processing tray F by the staple discharge roller 11 and is then sequentially stacked on the end-face binding processing tray F. In this case, each sheet is aligned by a tapping roller 12 and a rear-end reference fence 51 in the vertical direction (sheet conveying direction) and is aligned by the jogger fence 53 in the traverse direction (a direction perpendicular to the sheet conveying direction, also referred to as the sheet width direction). The end-face binding stapler S1, which is a binding unit, is driven in accordance with a staple signal received from a CPU 101, which will be described later, during the interval between jobs, i.e., during the interval between the final sheet of the sheet bundle PB and the leading sheet of the subsequent sheet bundle, whereby a binding process is performed. After the binding process is performed, the bundle PB of sheets is immediately delivered to the pair of (shift) discharge rollers 6 by a release belt 52 (see FIG. 2) from which a release claw 52*a* protrudes. The bundle PB of sheets is then discharged into the shift tray 202 that is set in the receiving position.

Figure 2:
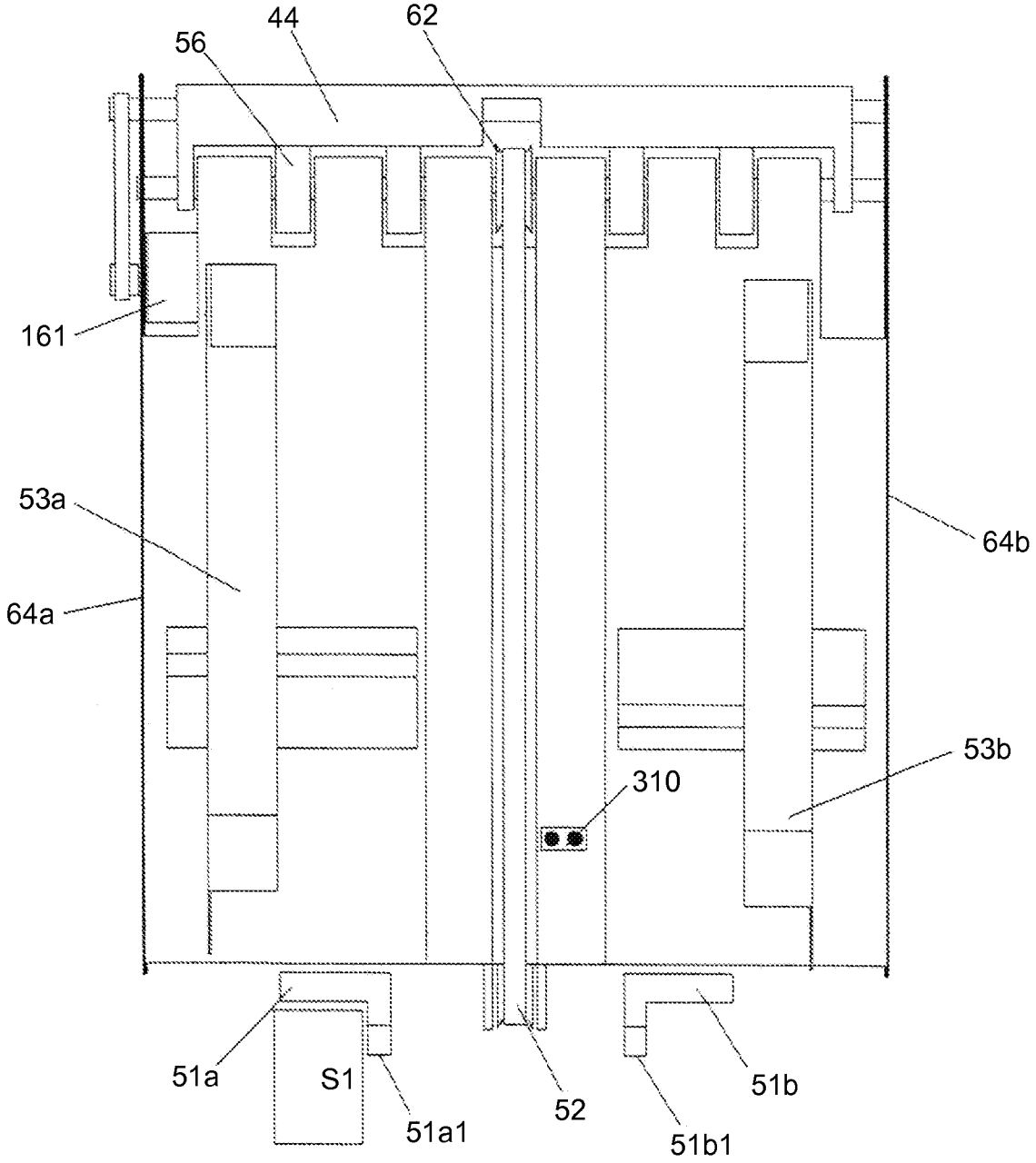
FIG. 2 is a schematic configuration diagram of an end-face binding processing tray illustrated in FIG. 1 when viewed from the tray stack surface side.
Figure 4:
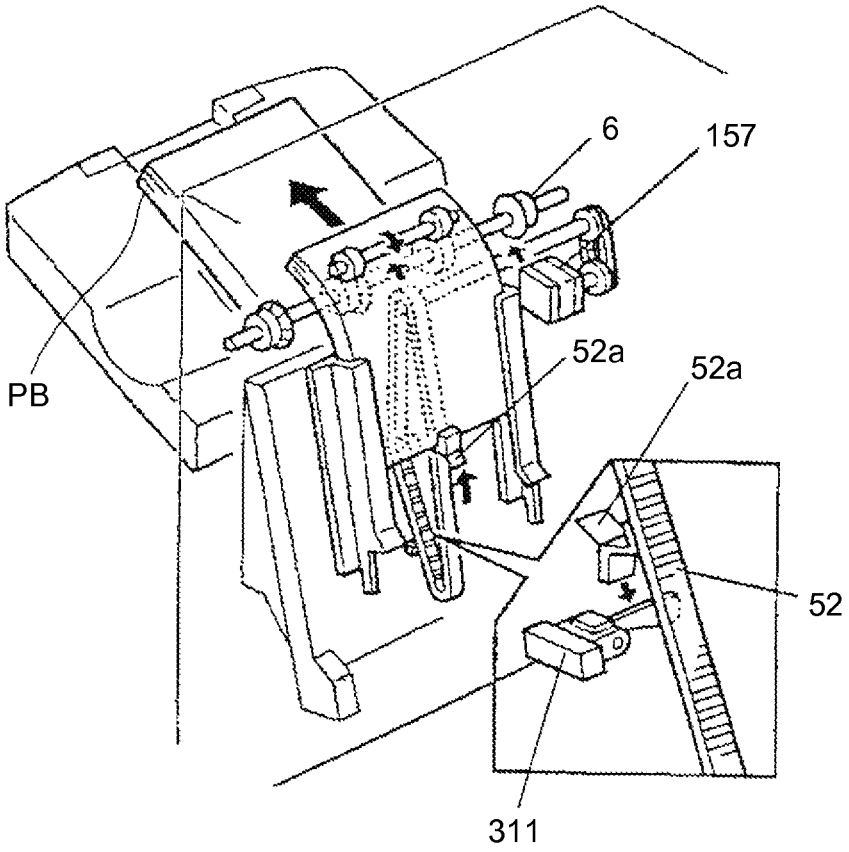
FIG. 4 is a perspective view that illustrates an operation of a release belt illustrated in FIG. 1.

As illustrated in FIGS. 2 and 4, the release belt 52 is located in the center with respect to the sheet width direction for alignment. The release belt 52 is extended between pulleys 62 and is driven by a release-belt drive motor 157. Multiple release rollers 56 are arranged symmetrically with respect to the release belt 52. The release rollers 56 are rotatably attached to the drive shaft so as to function as driven rollers.

The home position of the release claw 52*a* is detected by a release-belt HP sensor 311. The release-belt HP sensor 311 is turned on/off by the release claw 52*a* provided on the release belt 52. The two release claws 52*a* are provided at opposite positions on the outer circumference of the release belt 52 to alternately move and convey the bundle PB of sheets that is housed in the end-face binding processing tray F. Furthermore, if needed, it is possible to rotate the release belt 52 in the opposite direction so as to align the leading edges of the sheets in the bundle PB housed in the end-face binding processing tray F in the conveying direction by using the back side of the release claw 52*a* that is on the opposite side of the release claw 52*a* that is on stand-by to move the bundle PB of sheets.

As illustrated in FIG. 1, the reference numeral 110 denotes a trailing-edge pressing lever. The trailing-edge pressing lever 110 is located on the lower end of the rear-end reference fence 51 so as to press the trailing edges of the sheets in the bundle PB contained in the rear-end reference fence 51. The trailing-edge pressing lever 110 moves back and forth in substantially a vertical direction with respect to the end-face binding processing tray F. After being discharged into the end-face binding processing tray F, each sheet P is aligned by the tapping roller 12 in the vertical direction (sheet conveying direction); however, if the trailing edge of the sheet stacked on the end-face binding processing tray F is curled or if the stiffness of the sheet is low, the trailing edge of the sheet tends to bend and curl due to its own weight. Moreover, if the number of sheets stacked is increased, the space for receiving a subsequent sheet within the rear-end reference fence 51 becomes smaller; therefore, the sheet tends to be aligned in a vertical direction in a poor manner. That is why a trailing-edge pressing mechanism is provided to make the trailing edge PT of the sheet less curled and to make the sheet P easily enter the rear-end reference fence 51. The trailing-edge pressing lever 110 directly presses the sheet P or the bundle PB of sheets.

As illustrated in FIG. 1, the reference numerals 302, 303, 304, 305, and 310 denote sheet detection sensors. They detect whether a sheet has passed through the installed position or detects whether a sheet has been stacked.

FIG. 2 is a schematic configuration diagram of the end-face binding processing tray F when viewed from the tray stack surface side, and it corresponds to the one when viewed from the right side in FIG. 1. In FIG. 2, the sheet received from the image forming apparatus PR located on the upstream side is aligned in the width direction by jogger fences 53*a* and 53*b* and is aligned in the vertical direction when the sheet comes into contact with rear-end reference fences 51*a*, 51*b* (indicated by the reference numeral 51 in FIG. 1). The rear-end reference fences 51*a*, 51*b* include stack surfaces 51*a*1, 51*b*1, respectively, whose inner surfaces are in contact with the sheet trailing edge PT to support them, whereby the sheet trailing edge PT is supported at the two points. After the alignment operation is completed, the end-face binding stapler S1 performs a binding process. As can be seen from the perspective view in FIG. 4 that illustrates the operation of the release belt, the release belt 52 is driven by the release-belt drive motor 157 in a counterclockwise direction. Thus, the bundle PB of sheets on which the binding process has been performed is lifted up to a predetermined position by the rear-end reference fences 51*a*, 51*b*, is picked up by the release claw 52*a* attached to the release belt 52, and is then released from the end-face binding processing tray F. The reference numerals 64*a*, 64*b* denote a front side plate and a rear side plate, respectively. This operation can be performed in the same manner on an unbound bundle on which the binding process is not performed after the alignment process.

Figure 3:
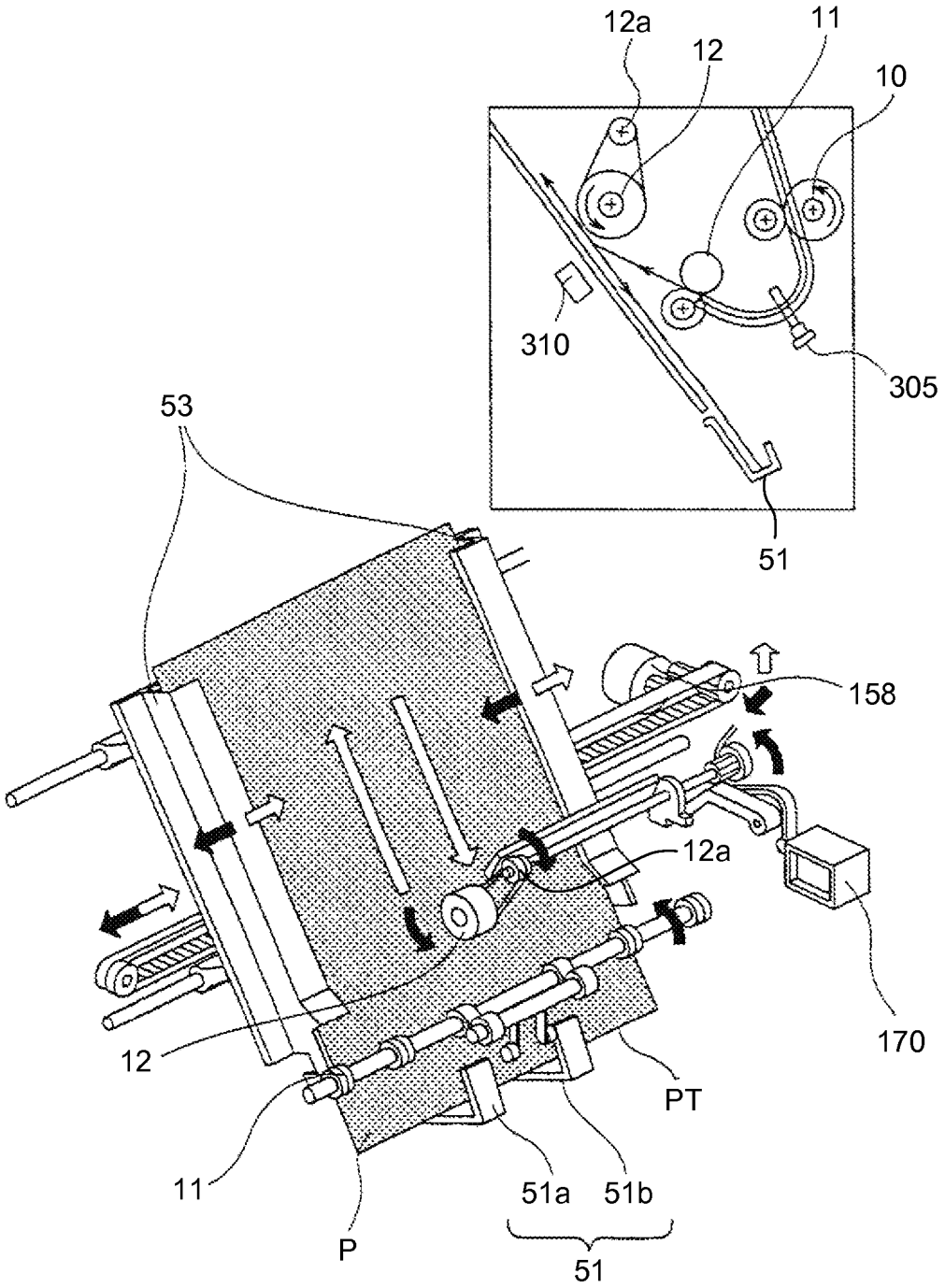
FIG. 3 is a perspective view that illustrates the schematic configuration of the end-face binding processing tray illustrated in FIG. 1 and its attached mechanism.

FIG. 3 is a perspective view that illustrates the schematic configuration of the end-face binding processing tray F and its attached mechanism. As illustrated in FIG. 3, after being guided to the end-face binding processing tray F by the staple discharge roller 11, the sheet P is sequentially stacked on the end-face binding processing tray F. At that time, when one sheet P is discharged into the end-face binding processing tray F, each sheet is aligned in the vertical direction (sheet conveying direction) by the tapping roller 12 and the rear-end reference fence 51 and is aligned in the width direction (the sheet width direction perpendicular to the sheet conveying direction) by the jogger fences 53*a* and 53*b*. A tapping SOL 170 applies a pendulum movement to the tapping roller 12 around a supporting point 12*a*, whereby the tapping roller 12 intermittently acts on the sheet delivered to the end-face binding processing tray F so that the sheet trailing edge PT comes into contact with the rear-end reference fence 51. The tapping roller 12 rotates in a counterclockwise direction as illustrated in the drawing. As illustrated in FIGS. 2 and 3, the pairs of jogger fences 53 (53*a*, 53*b*) are provided on the front and rear sides, are driven via a timing belt by a jogger motor 158 that can rotate in the normal and opposite directions, and are moved back and forth in a symmetric manner in the sheet width direction such that they are located close to or away from each other.

Referring back to FIG. 1, a sheet-bundle turning mechanism is provided on the downstream side of the end-face binding processing tray F along the sheet conveying direction. The conveyance paths for conveying the sheet bundle PB from the end-face binding processing tray the center-binding processing tray G and from the end-face binding processing tray F to the shift tray 202 and a conveying unit for conveying the sheet bundle PB are made up of a conveying mechanism 35 that applies a conveyance force to the sheet bundle PB; the release roller 56 that turns the sheet bundle PB; and the guide member 44 that guides the sheet bundle PB to turn the sheet bundle PB.

An explanation is given of the detailed configuration of each unit. A configuration is such that the driving force of a drive shaft 37 is transmitted to a roller 36 of the conveying mechanism 35 via a timing belt. The roller 36 and the drive shaft 37 are connected to each other and are supported via an arm, and the roller 36 is swingable around the drive shaft 37 as its rotation support point. The roller 36 of the conveying mechanism 35 is driven and swung by a cam 40. The cam 40 rotates about its rotation axis and is driven by an undepicted motor. In the conveying mechanism 35, a driven roller 42 is located at the position opposed to the roller 36. The sheet bundle PB is sandwiched between the driven roller 42 and the roller 36 and is pressed by an elastic member so that a conveyance force is applied.

The conveyance path for turning the sheet bundle PB from the end-face binding processing tray F to the center-binding processing tray G is formed between the release roller 56 and the inner surface of the guide member 44 that is opposed to the release roller 56. The guide member 44 rotates around its supporting point, and its driving force is transmitted from a bundle-separation drive motor 161 (see FIG. 2). To convey the sheet bundle PB from the end-face binding processing tray F to the shift tray 202, the guide member 44 rotates around its supporting point in the illustrated clockwise direction so that the space between the outer surface of the guide member 44 (the surface that is not opposed to the release roller 56) and a guide plate located on the outside thereof function as a conveyance path. To convey the sheet bundle PB from the end-face binding processing tray F to the center-binding processing tray G, the trailing edge of the sheet bundle PB, which has been aligned by the end-face binding processing tray F, is pushed up by the release claw 52*a*, and the sheet bundle PB is sandwiched between the roller 36 of the conveying mechanism 35 and the driven roller 42 that is opposed to the roller 36 so that a conveyance force is applied. At that time, the roller 36 of the conveying mechanism 35 stands by at a position where it does not hit the leading edge of the sheet bundle PB. Then, after the leading edge of the sheet bundle passes by, the roller 36 of the conveying mechanism 35 is brought into contact with the surface of the sheet so that a conveyance force is applied. At that time, the guide for a turn conveyance path is formed by the guide member 44 and the release roller 56, and the sheet bundle PB is conveyed downstream to the center-binding processing tray G.

As illustrated in FIG. 1, the center-binding processing tray G is located downstream of the sheet-bundle turning mechanism that includes the conveying mechanism 35, the guide member 44, and the release roller 56. The center-binding processing tray G is arranged in substantially a vertical direction on the downstream side of the sheet-bundle turning mechanism. A center-folding mechanism is provided in the middle section of the center-binding processing tray G, an upper bundle conveyance guide plate 92 is provided in the upper section thereof, and a lower bundle conveyance guide plate 91 is provided in the lower section thereof.

An upper bundle conveying roller 71 is provided in the upper section of the upper bundle conveyance guide plate 92 and a lower bundle conveying roller 72 is provided in the lower section thereof. The upper center-binding jogger fences 250*a* are provided on both side surfaces of the upper bundle conveyance guide plate 92 and are extended between the rollers 71, 72. In the same manner, the lower center-binding jogger fences 250*b* are provided on both side surfaces of the lower bundle conveyance guide plate 91. A center-binding stapler S2 is provided at the position where the lower center-binding jogger fences 250*b* are located. The upper center-binding jogger fence 250*a* and the lower center-binding jogger fence 250*b* are driven by an undepicted drive mechanism to perform an alignment operation in a direction (sheet width direction) perpendicular to the sheet conveying direction. The center-binding stapler S2 includes a pair of a clincher unit and a driver unit. Two pairs are provided at a predetermined interval in the sheet width direction.

A movable rear-end reference fence 73 is provided such that it passes across the lower bundle conveyance guide plate 91 and can be moved in the sheet conveying direction (the vertical direction in the drawing) by a moving mechanism that includes a timing belt and its driving mechanism. As illustrated in FIG. 1, the driving mechanism includes a drive pulley and a driven pulley between which the timing belt is extended and includes a stepping motor that drives the drive pulley. In the same manner, a trailing-edge tapping claw 251 and its driving mechanism are provided on the upper end of the upper bundle conveyance guide plate 92. The trailing-edge tapping claw 251 can be moved back and forth by a timing belt 252 and an undepicted driving mechanism in a direction away from the sheet-bundle turning mechanism and in a direction for pushing the trailing edge of the sheet bundle PB (the side to be in contact with the trailing edge when the sheet bundle is delivered).

The center-folding mechanism is provided in substantially the middle of the center-binding processing tray G and includes the folding plate 74, the folding roller 81, and the conveyance path H for conveying the folded sheet bundle PB. In FIG. 1, the reference numeral 326 denotes a home-position sensor that detects the home position of the trailing-edge tapping claw 251, the reference numeral 323 denotes a folded-portion passage sensor that detects the center-folded sheet, the reference numeral 321 denotes a bundle detection sensor that detects whether the sheet bundle PB has reached the center-folding position, and the reference numeral 322 denotes a movable rear-end reference-fence home-position sensor that detects the home position of the movable rear-end reference fence 73.

According to the present embodiment, a detection lever 501 is provided in the lower tray 203 to detect the pile height of the bundle PB of center-folded sheets and is swingable around a supporting point 501*a*. The angle of the detection lever 501 is detected by a sheet-surface sensor 505 so that the lifting/lowering operation of the lower tray 203 is performed and the overflow is detected.

Figure 5:
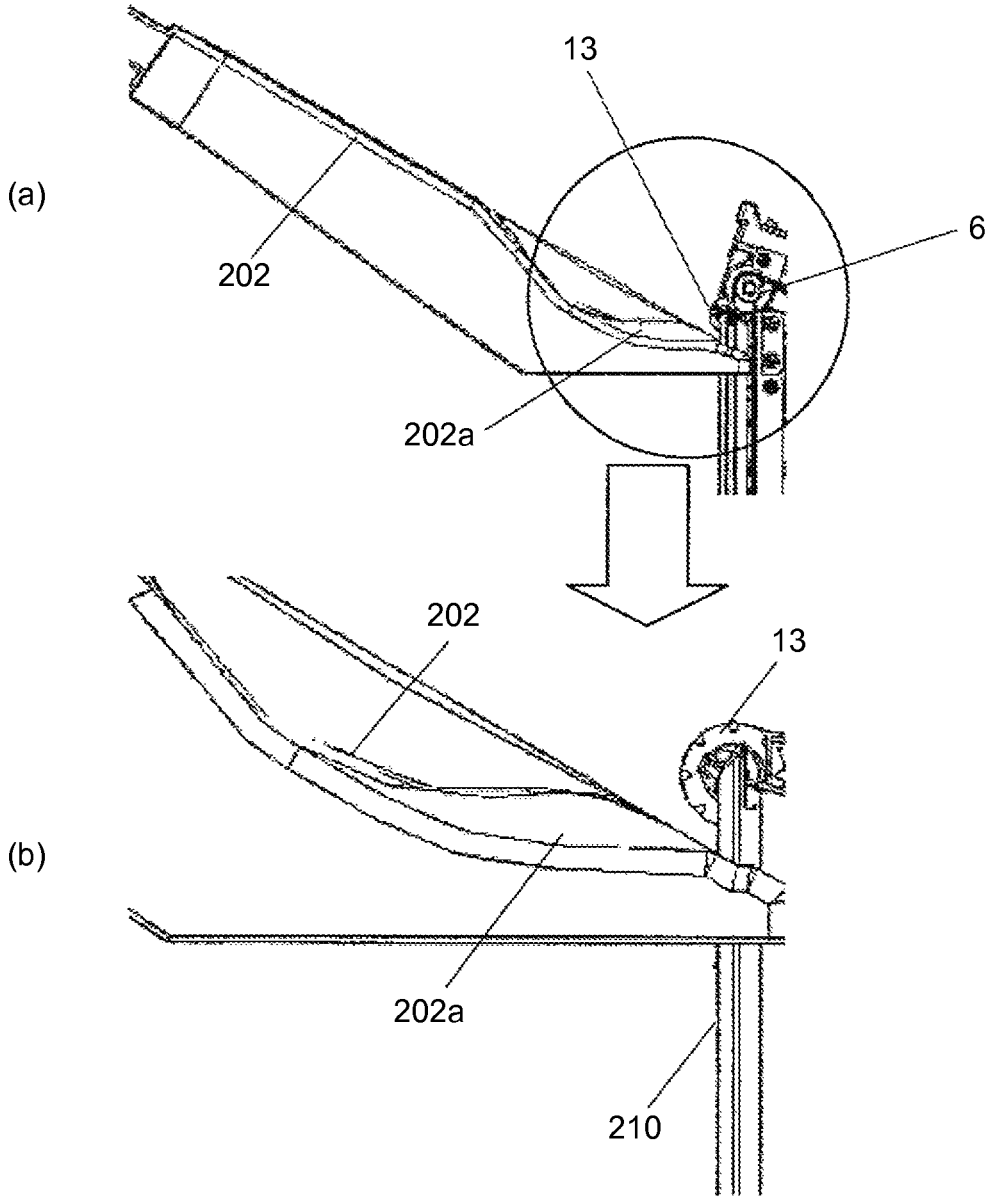
FIG. 5 is a relevant-part front view that illustrates the standby state of a shift tray illustrated in FIG. 1.

FIG. 5 is a relevant-part front view that illustrates a discharge section of the shift tray 202. FIG. 5(*a*) is a diagram that illustrates the standby state during discharge, and FIG. 5(*b*) is an enlarged view that further illustrates the relevant part indicated by the circle in FIG. 5(*a*). As described above, the sheet P is conveyed to the shift tray 202 via the pair of discharge rollers 6 (6*a*, 6*b*), and then the sheet P is sorted by the shift tray 202. As described above, the sheet P is sorted, specifically, by the pair of shift discharge rollers 6; the return roller 13; the shift tray 202; a shift mechanism; and a shift-tray lifting/lowering mechanism.

Figure 6:
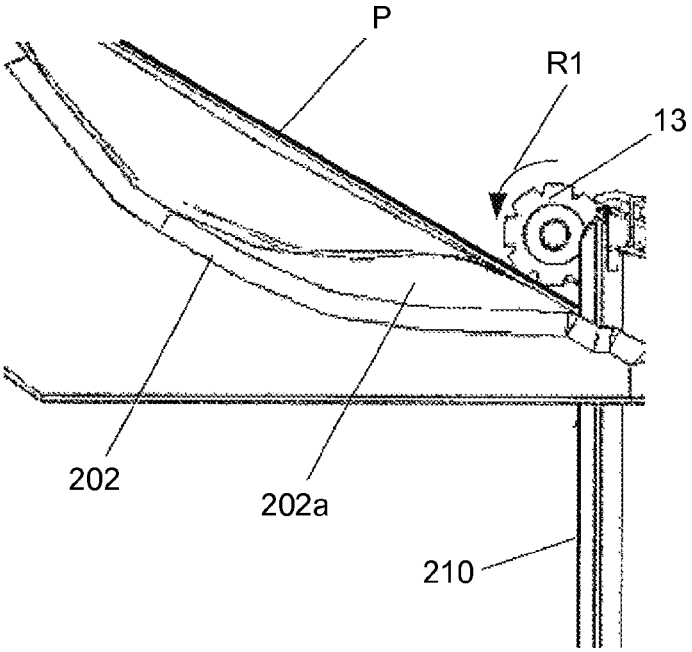
FIG. 6 is an operation explanatory diagram that illustrates the alignment operation performed on the shift tray in the conveying direction.

FIG. 6 is an operation explanatory diagram that illustrates the alignment operation in the conveying direction. After the sheet is discharged, the return roller 13 is brought into contact with the sheet P while the return roller 13 rotates in the direction (the direction of the arrow R1) to return the sheet P toward an end fence 210, and then the return roller 13 performs an operation to actively return the sheet P toward the end fence 210, whereby the alignment operation is performed. Here, the return roller 13 is driven by an undepicted return-roller drive motor, and the drive force is transmitted via the timing belt.

Figure 7:
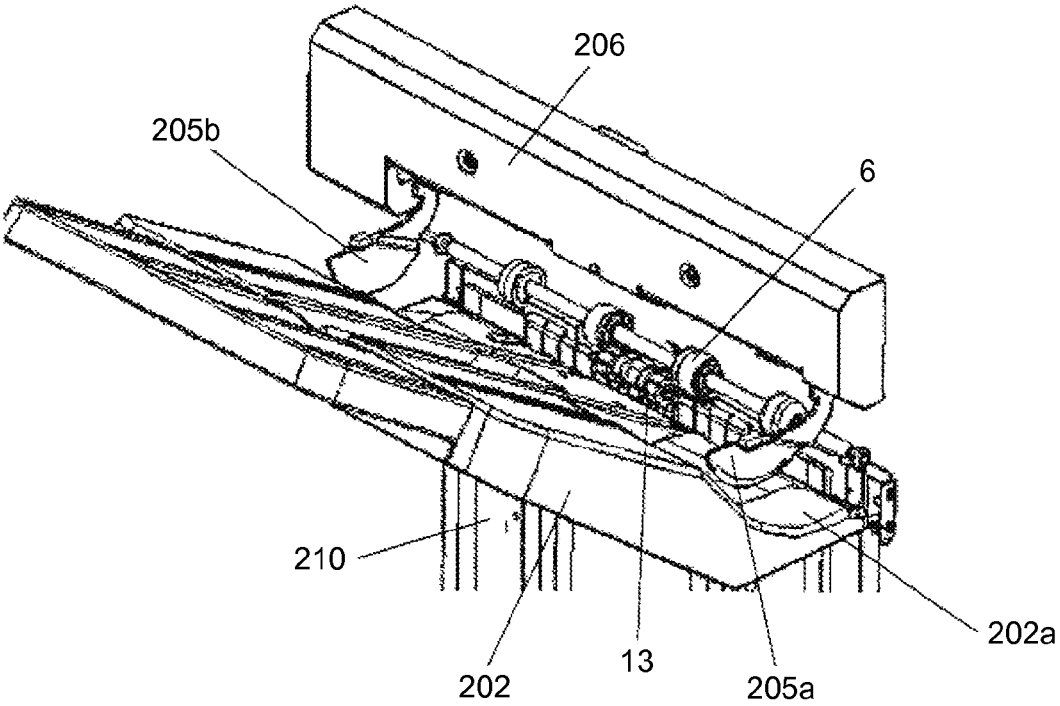
FIG. 7 is a perspective view of a discharge section that includes the shift tray and discharge rollers.

FIG. 7 is a perspective view of the discharge section that includes the shift tray and the discharge rollers. As can be seen from FIG. 7, a pair of joggers 205*a*, 205*b* is located above the shift tray 202 so as to align the sheet P on the shift tray 202 in the width direction. The joggers 205*a* and 205*b* are movable in the width direction of the sheet P by a jogger drive mechanism 206. The jogger drive mechanism 206 has a well-known structure, and the drive mechanism itself is not directly related to the present invention; therefore, a detailed explanation thereof is omitted. In FIG. 5, and the like, the reference numeral 202*a* denotes an allowance (recessed section) that allows the joggers 205*a* and 205*b* to move.

Figure 8:
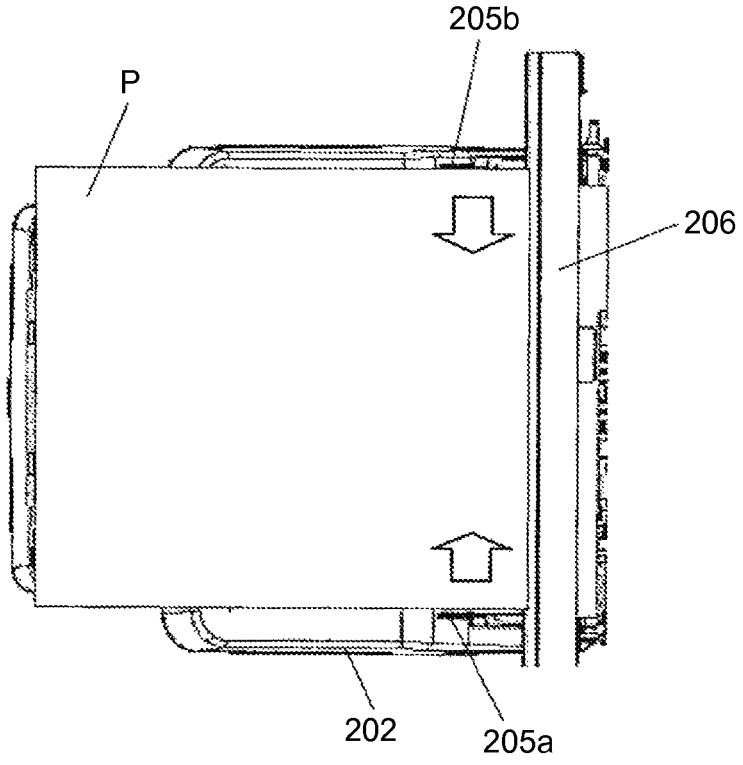
FIG. 8 is a diagram that illustrates the alignment operation performed on the shift tray in the sheet width direction.
Figure 9:
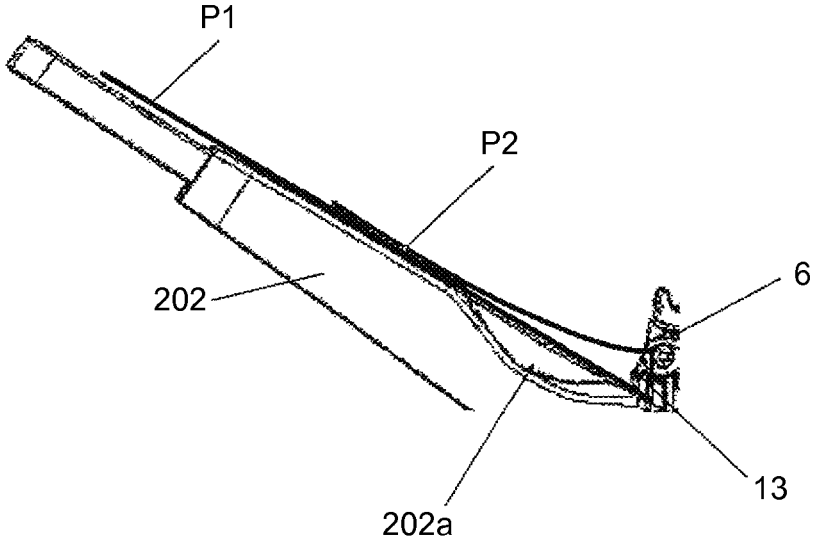
FIG. 9 is a diagram that illustrates a state where the leading sheet is stacked on the shift tray and then the subsequent sheet is discharged into the shift tray.
Figure 10:
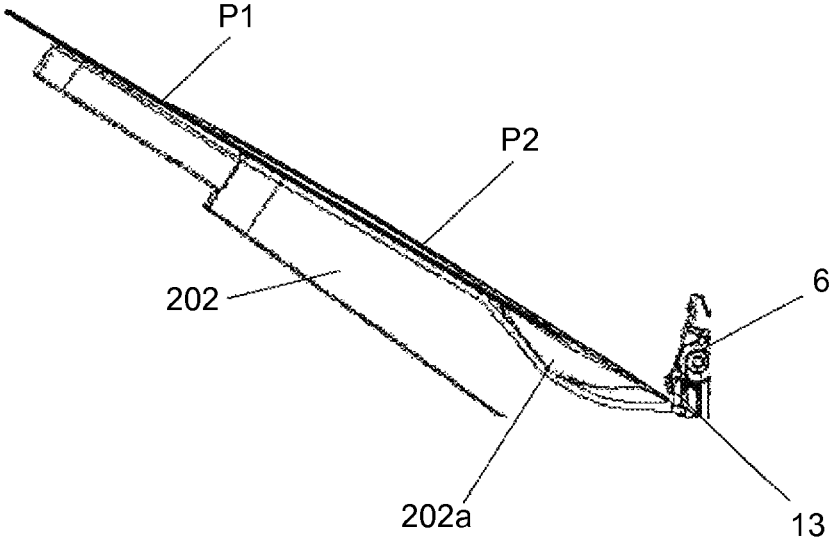
FIG. 10 is a diagram that illustrates a state where the sheets stick to each other due to the adhesion between the sheets after the state illustrated in FIG. 9, and the subsequent sheet pushes the leading sheet out.
Figure 11:
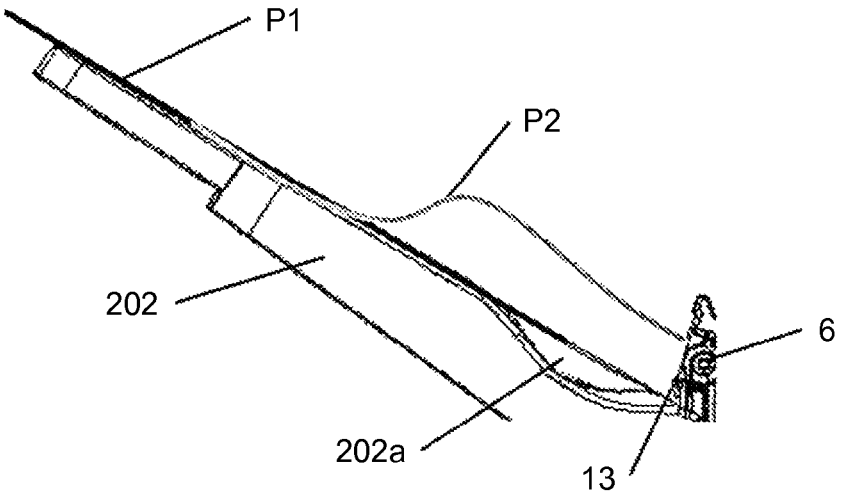
FIG. 11 is a diagram that illustrates a state where the sheets stick to each other due to the adhesion between the sheets after the state illustrated in FIG. 9, and the subsequent sheet is curled (bent)

FIG. 8 is a diagram that illustrates the alignment operation performed on the shift tray 202 in the sheet width direction. After the sheet P is discharged, the sheet P is aligned in its width direction by the front-side jogger 205*a* and the rear-side jogger 205*b* on the front side and the rear side, respectively, in the sheet width direction. However, a problem occurs in the case of the sheet P, such as a coated sheet, which has a high degree of smoothness. For example, as illustrated in FIG. 9, if the leading sheet P1 is stacked on the shift tray 202 and then the subsequent sheet P2 is discharged into the shift tray 202, the sheets stick to each other due to a tight adhesion between the sheets. If the sheets stick to each other, the subsequent sheet P2 sometimes pushes the leading sheet P1 out while the subsequent sheet P2 is in contact with the leading sheet P1, as illustrated in FIG. 10. Furthermore, in some cases, the leading end of the sheet P2 adheres to the sheet P1 so that the subsequent sheet P2 is not conveyed any further, and the subsequent sheet P2 is curled (bent), as illustrated in FIG. 11. The occurrence of these phenomena causes a discharge failure.

According to the present embodiment, in order to prevent the leading sheet P1 from being pushed out or prevent the subsequent sheet P2 from being bent, a blower is provided so that, when the subsequent sheet P2 is discharged, the blower applies air W into the gap between the leading sheet P1 and the subsequent sheet P2 (toward the lower surface of the subsequent sheet), whereby the subsequent sheet P2 is prevented from adhering to the leading sheet P1. While the conveying force is applied to the subsequent sheet P2 due to the air W, the subsequent sheet P2 is not brought into contact with the leading sheet P1; thus, it is possible to ensure that the occurrence of the above-described phenomena illustrated in FIGS. 10 and 11 is prevented.

Figure 12:
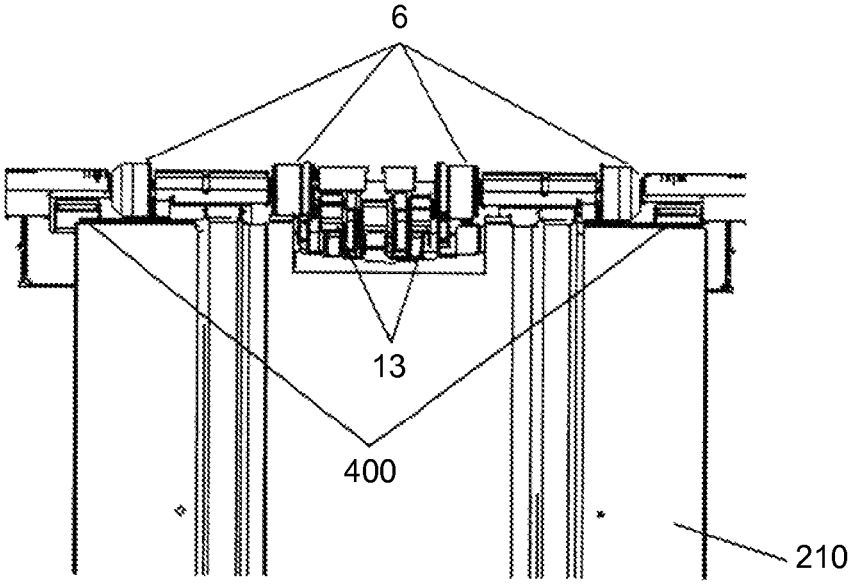
FIG. 12 is a left side view of FIG. 10 and illustrates a state where the sheet is omitted.
Figure 13:
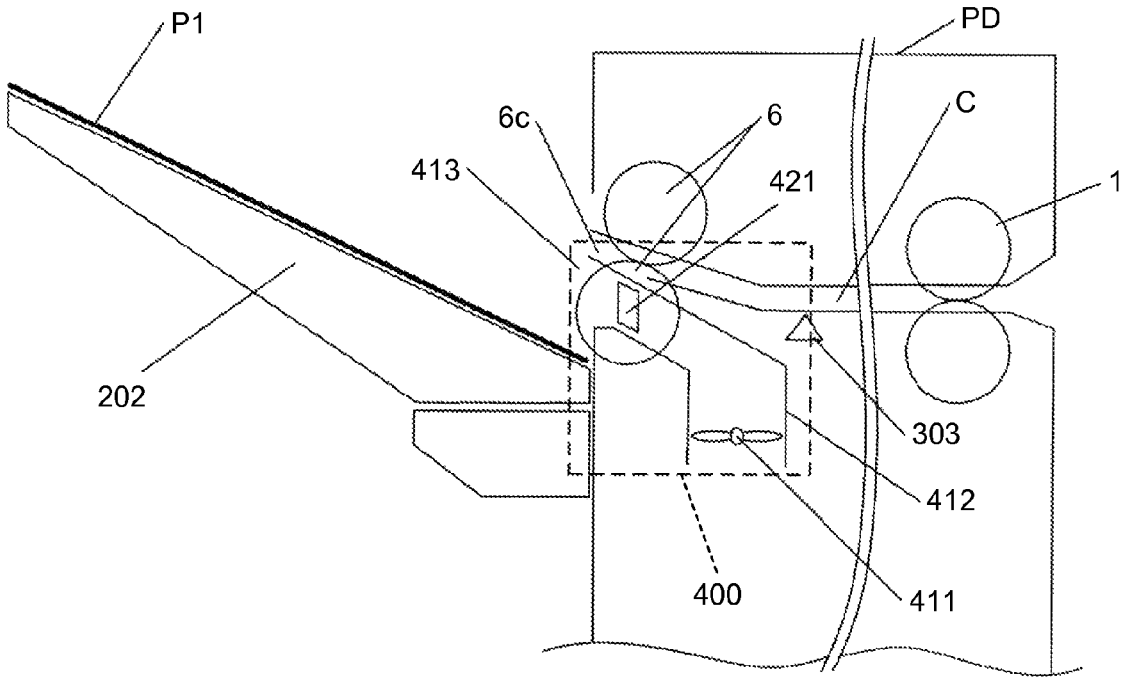
FIG. 13 is a relevant-part front view that illustrates the structure of a sheet discharge section that includes a blower according to the present embodiment.

FIG. 12 is a left side view of FIG. 10, and FIG. 13 is a relevant-part front view that illustrates the structure of a sheet discharge section that includes the blower according to the present embodiment. The sheet is omitted from FIG. 12, and the central part of the sheet post-handling apparatus PD illustrated in FIG. 1 as viewed from the front is omitted from FIG. 13.

As illustrated in FIGS. 12 and 13, a pair of blowers 400 is provided such that they are located externally (on two sides) of the four discharge rollers 6 that are arranged along the sheet width direction (the direction perpendicular to the sheet conveying direction D1). As illustrated in FIG. 13, the blower 400 includes a blower fan 411, a blower duct (blower guide) 412, and a louver 421. The blower fan 411 is driven by an undepicted coaxially-mounted motor so as to supply, through a blower opening 413 of the blower duct 412, the air W that has a wind speed corresponding to the rotating speed of the motor.

The blower opening 413 is located most downstream of the blower duct 412. As illustrated in FIG. 13, the blower opening 413 is located below the upper roller 6*a* included in the pair of discharge rollers 6 or below the discharge port 6*c* and is located at a position above the shift tray 202. Thus, it is possible to send the air W into the gap between the upper surface of the shift tray 202 and the sheet P discharged though the pair of discharge rollers 6 (the lower surface of the discharged sheet P). Air blowing is performed on the basis of the sheet information that is transmitted from the image forming apparatus PR, i.e., only when a sheet is delivered. At that time, it is possible to manually adjust the wind speed (air volume). In the present embodiment, the single pair of blowers 400 (the two blowers 400) is installed; however, the number of blowers 400 to be installed may be more than two.

The blower duct 412 is located under the conveyance path C. The upward flow of air supplied by the blower fan 411 is deflected in the form of the blower duct 412 so as to be sent obliquely upward and is then supplied through the blower opening 413, as described above.

Figure 14:
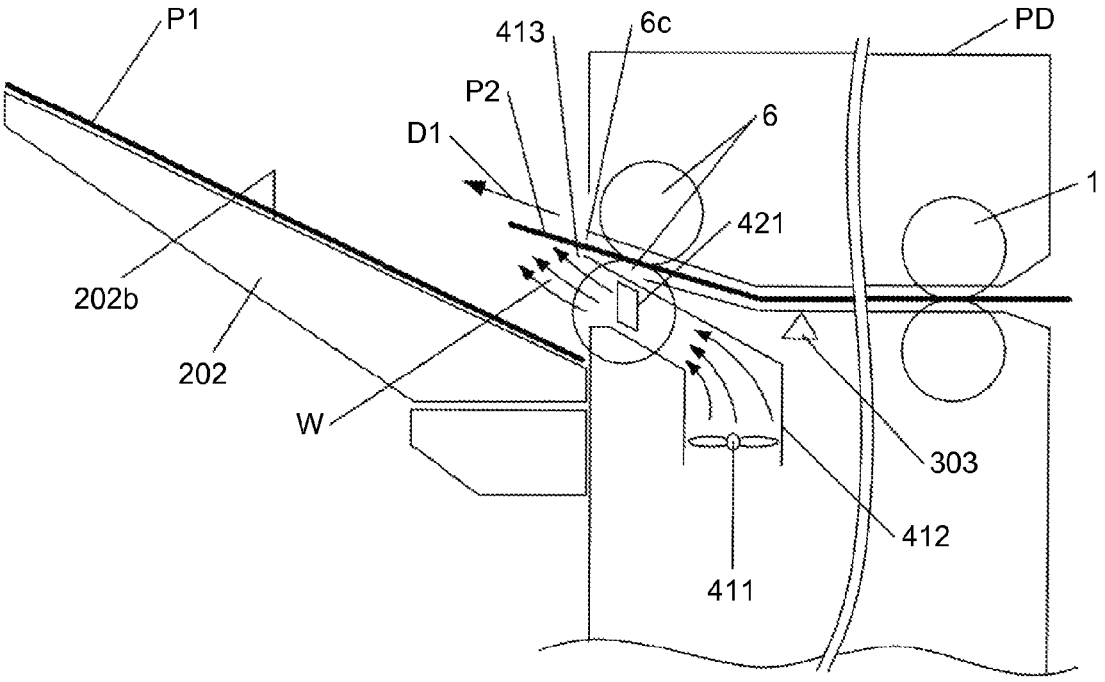
FIG. 14 is an operation explanatory diagram that illustrates an operation of the blower that includes the louver and the state of supplied air and illustrates the state where the second sheet is just started to be discharged.
Figure 15:
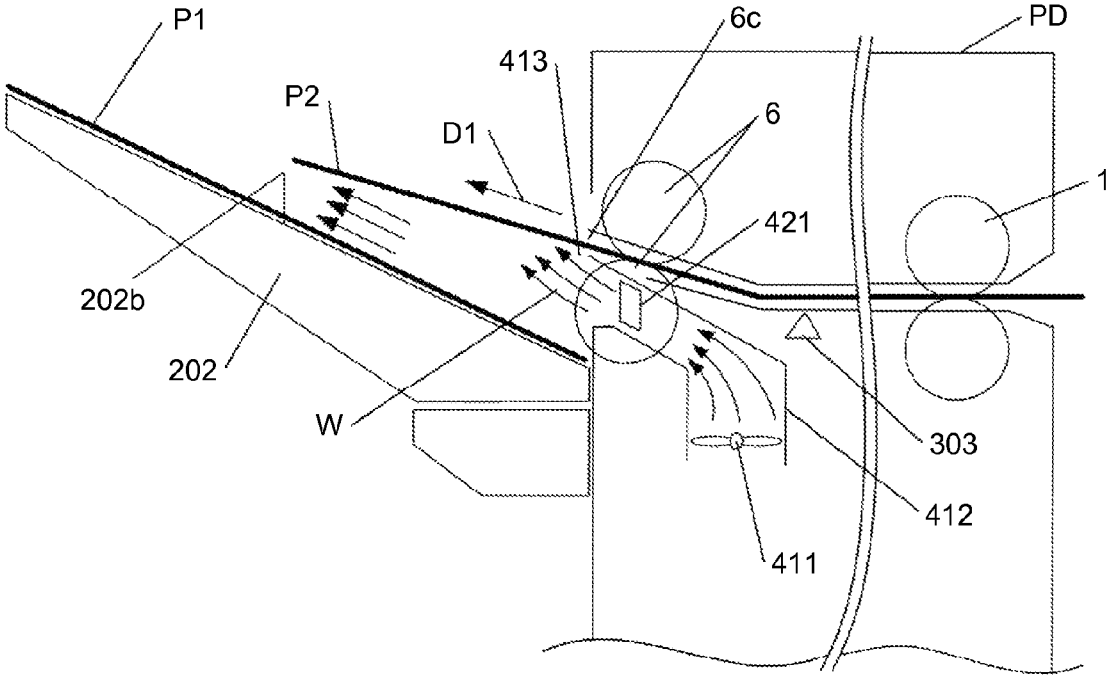
FIG. 15 is an operation explanatory diagram that illustrates a state where the discharge of the sheet is carried out to some extent after the state illustrated in FIG. 14.
Figure 16:
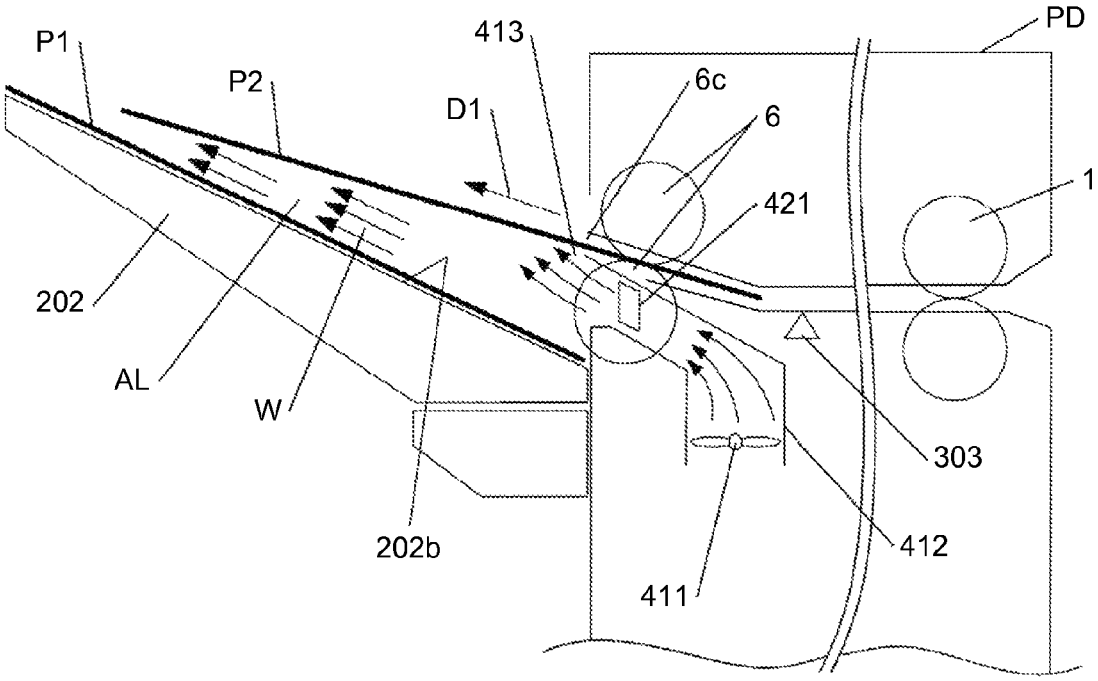
FIG. 16 is an operation explanatory diagram that illustrates a state just before the discharge of the sheet is completed after the state illustrated in FIG. 15.

FIGS. 14, 15, and 16 are operation explanatory diagrams that illustrate the operations of the blower that includes the louver and illustrate the states of supplied air.

FIG. 14 illustrates the state where the first sheet (the leading sheet) P1 is conveyed in the direction of the arrow D1 illustrated in FIG. 14 and discharged into the shift tray 202 and then the second sheet (the subsequent sheet) P2 is just started to be discharged. Before the above state is obtained, i.e., when the sheet P2 is discharged into the shift tray 202, the blower fan 411 of the blower 400 is driven so that the air W is supplied toward the back surface (the lower surface) of the subsequent sheet P2. By this air supplying operation, as illustrated in FIG. 15, an air layer AL is formed between the leading sheet P1 on the shift tray 202 and the subsequent sheet P2. The sheet P2 is released from the nip between the discharge rollers 6 after the state illustrated in FIG. 16 and then drops down onto the sheet P1 on the shift tray 202 while the air layer AL is removed. When the sheet P2 is moved under the return roller 13, the sheet P2 is conveyed by the return roller 13 in the direction opposite to the conveying direction, and the sheet trailing edge PT comes into contact with the end fence 210 so that the sheet P is aligned in the conveying direction.

If there is no leading sheet P1 and the sheet P1 is directly discharged into the shift tray 202, the air is supplied toward the back surface of the sheet P1 in the same manner so that the air layer AL is formed between the sheet P1 and the shift tray 202, whereby the adhesion between sheets is prevented. At this time, the angle of the blower duct 412 of the blower 400 in relation to the horizontal is the same as that of a sheet stack surface 202*b* of the shift tray 202 in relation to the horizontal so that air is supplied parallel to the sheet stack surface 202*b* of the shift tray 202. That is, the air W is supplied parallel to the sheet stack surface 202*b*.

Figure 17:
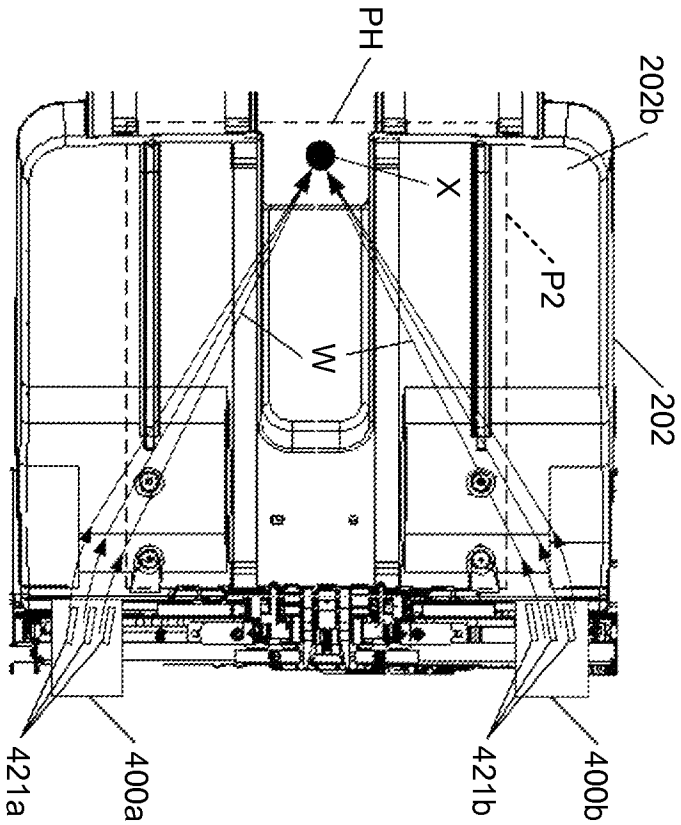
FIG. 17 is an explanatory diagram that illustrates the direction of air supplied by the blower, where the intersection point is set on the shift tray.

As illustrated in FIG. 17, with respect to the sheet width direction, the angle of each of louvers 421*a* and 421*b* of the two blowers 400 (400*a* and 400*b*) is set such that the air supplied by the blower 400*a* meets or intersects with the air supplied by the blower 400*b* at the point X on the sheet stack surface 202*b* of the shift tray 202. The point X, which is the meeting point or the intersection point, is a position on the downstream side of the shift tray 202 and is the central position of the shift tray 202 in the sheet width direction. The point X may be at any position in the sheet conveying direction; however, it is preferable that the air intersects at a position corresponding to the leading end of a sheet or at a position proximal to the leading end of a sheet. In FIG. 17, the subsequent sheet P2 is indicated by the chained line. FIG. 17 illustrates a state where the intersection point X is set at a position corresponding to the leading end of a sheet, the position being slightly away from the leading edge PH of the sheet.

In a case where the louver 421 is fixed, it is reasonable that, when the most frequently used sheet is discharged into the shift tray 202, the intersection point X is set at a position corresponding to the leading end of the sheet depending on its sheet size.

As described above, when the air W is sent from the blowers 400*a* and 400*b*, at both ends of the sheet P discharged into the shift tray 202, to the central part of the sheet P in the width direction and to the leading end of the sheet P, the air layer AL is formed on the entire sheet surface of the discharged sheet P in the width direction and in the conveying direction, whereby it is possible to effectively prevent or reduce the adhesion between the sheets. Accordingly, it is possible to prevent the subsequent sheet P2 from being bent or from adhering to the leading sheet P1; thus the desirable alignment accuracy can be obtained.

Figure 18:
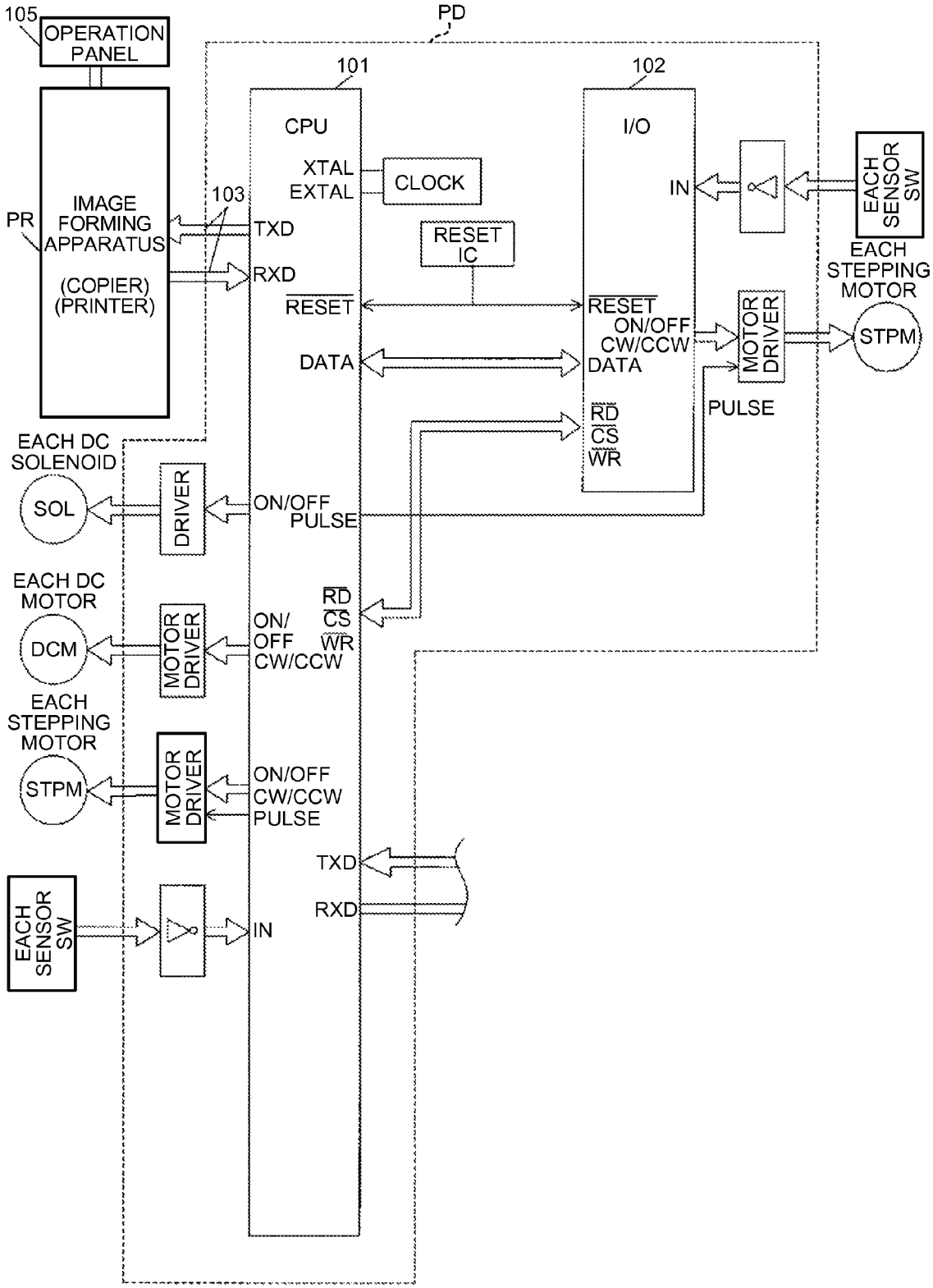
FIG. 18 is a block diagram that illustrates a control configuration of the image forming system that includes the sheet post-handling apparatus and the image forming apparatus.

FIG. 18 is a block diagram that illustrates a control configuration of the image forming system that includes the sheet post-handling apparatus PD and the image forming apparatus PR. The sheet post-handling apparatus PD includes a control circuit on which a microcomputer including the CPU 101, an I/O interface 102, and the like, is mounted. The CPU 101 receives signals from a CPU of the image forming apparatus PR, various switches of an operation panel 105, various undepicted sensors, or the like, via a communication interface 103. The CPU 101 performs predetermined control in accordance with an input signal. Furthermore, the CPU 101 controls and drives a solenoid and a motor via a driver or a motor driver and acquires sensor information on the apparatus via the interface. Moreover, depending on a target to be controlled or a sensor, it controls and drives a motor by using a motor driver via the I/O interface 102 and acquires sensor information from a sensor. A program code stored in an undepicted ROM is read by the CPU 101 and loaded into an undepicted RAM and, while the RAM is used as a work area and data buffer, the above-described control is performed in accordance with the program defined by the program code.

In the present embodiment, the blowing mode is set so that air is supplied by the blower 400 toward the back surface (the lower surface) of the sheet. According to the setting, the blowing mode is set to be on when a user selects a coated sheet via the operation panel 105. It is possible that, if forcible off is selected, blowing is not performed even for coated sheets. Furthermore, in the case of regular sheets, blowing is not performed as default; however, blowing can be performed if forcible on is set.

Figure 19:
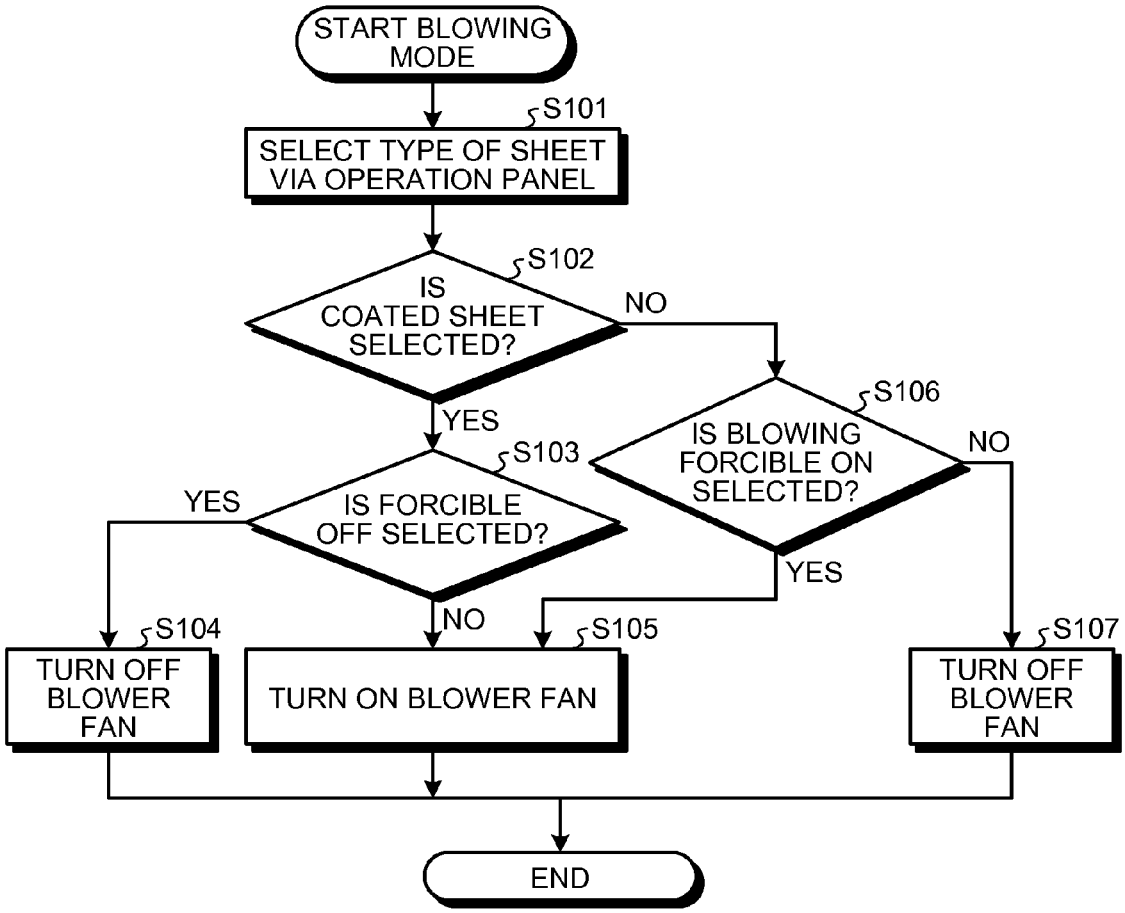
FIG. 19 is a flowchart that illustrates the steps of a blowing operation performed during a blowing mode.
Figure 20:
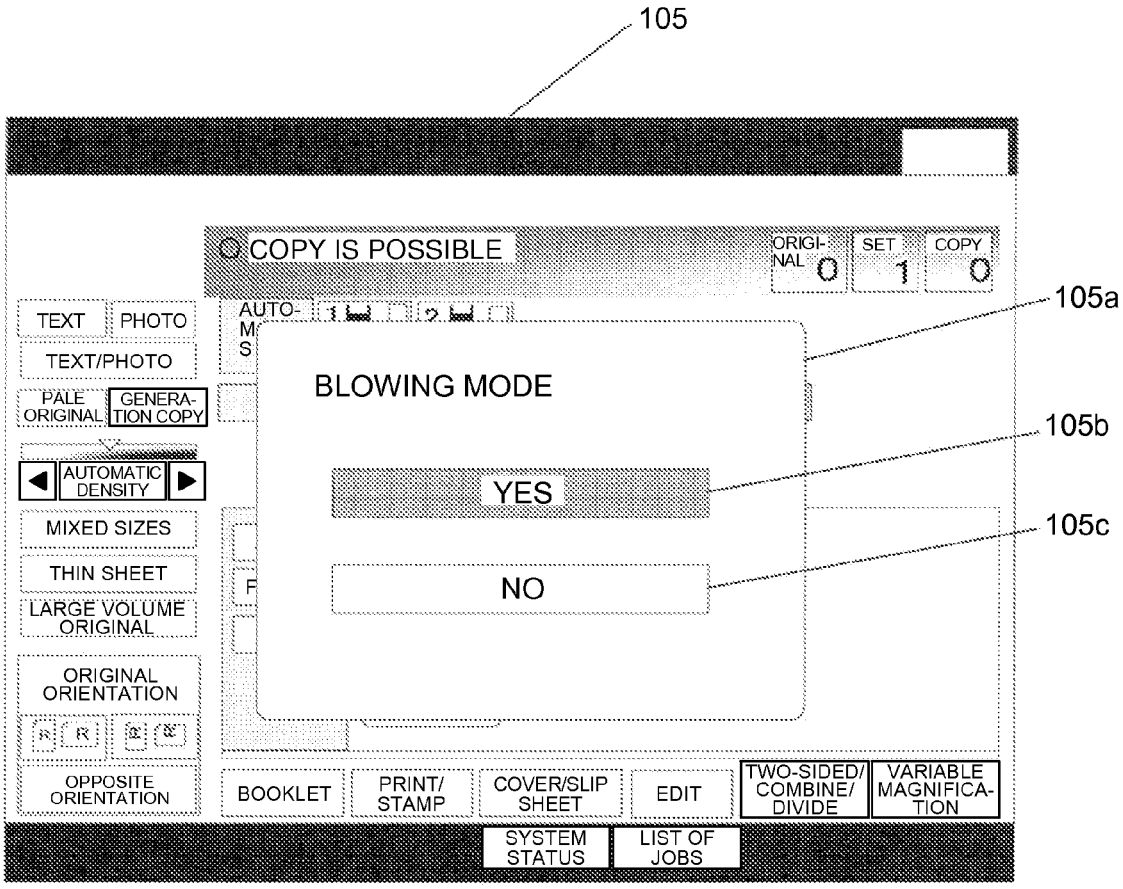
FIG. 20 is a diagram that illustrates a selection screen on an operation panel when a process to select the blowing mode is performed.

FIG. 19 is a flowchart that illustrates the steps of the blowing operation performed during the blowing mode. FIG. 20 is a diagram that illustrates a selection screen on the operation panel when the process to select the blowing mode is performed. The process illustrated in the flowchart is performed by the CPU 101 of the sheet post-handling apparatus PD.

During the process to select the blowing mode, when "Yes" 105*b* is selected on a designation screen 105*a* for the blowing mode via the operation panel 105 in FIG. 20, the process for the blowing mode is started. When the process for the blowing mode is started, the operation screen on the operation panel 105 is switched to an undepicted screen for selecting the type of sheet. Although not illustrated, this selection screen displays the types of sheets as selection buttons. If the type of sheet is selected (Step S101) so that the coated sheet is selected (Step S102: Yes), a switch is made to the screen for selecting blowing forcible off.

Specifically, according to the setting, the blower fan 411 is turned on when the coated sheet is selected. Therefore, before that, it is determined whether forcible off of the blower fan 411 is selected (Step S103). When forcible off is selected (Step S103: Yes), the blower fan 411 is turned off (Step S104), and then this routine is terminated.

If forcible off is not selected (Step S103: No), the blower fan 411 is turned on (Step S105) so that the air flow (the air W) is generated, and then this routine is terminated.

As blowing is off as default for other than coated sheets, it is further determined whether blowing forcible on is selected (Step S106). If blowing forcible on is selected (Step S106: Yes), the blower fan 411 is turned on (Step S105). If not selected (Step S106: No), the blower fan 411 is turned off (Step S107), and then this routine is terminated.

If "No" 150*c* is selected on the blowing mode screen, the normal discharge operation is performed without entering the blowing mode.

In the present embodiment, when a user selects the sheet type information via the operation panel 105, the blowing mode is set to be on in accordance with the setting; however, it is possible that, if forcible off is selected, blowing is not performed. Furthermore, in the case of regular sheets, blowing is not performed as default; however, if forcible on is set, blowing can be performed.

As described above, the present embodiment produces the following advantages.

1) There are provided the pair of discharge rollers 6 (a discharge unit) that discharges the sheet P through the discharge port 6*c*; the shift tray 202 (a stack unit) that has the discharged sheet P stacked thereon; and the plurality of blowers 400 (400*a* and 400*b*: blowing units) that supplies air to the discharge side while the sheet P is discharged. The blowers 400 are located below the discharge port 6*c* and are arranged along the direction perpendicular to the sheet discharge direction D1. Thus, it is possible to supply air toward the lower surface of the discharged sheet P at multiple points thereof arranged in the width direction. As a result, it is possible to generate a sufficient air layer that covers the leading end of the discharged sheet P, whereby the sheet P can be surely prevented from adhering or being bent, and the desirable alignment accuracy can be obtained.

2) The blowers 400 are provided at both ends of the shift tray 202 in the direction perpendicular to the sheet discharge direction; therefore, air can be supplied toward the lower surface of the discharged sheet P at both ends thereof. Thus, it is possible to produce the advantage described in the above 1).

3) The directions of air supplied by the blowers 400 at two ends are set such that they intersect with each other above the shift tray 202; therefore, the air (air flow) W intersects with another air W on the lower surface of the sheet P, whereby it is possible to form the sufficiently thick air layer AL that centers on the intersection point. Thus, the advantage described in the above 1) can be produced more effectively.

4) As the intersection point X (the point of intersection) where the directions of supplied air intersect with each other is set at the central part of the shift tray 202 in the width direction so that the air (air flow) W intersects with another air W on the lower surface of the sheet P at the center in the width direction, whereby it is possible to form the sufficiently thick air layer AL that centers on the central part of the sheet P in the width direction. Thus, the advantage described in the above 1) can be produced more effectively.

5) As the intersection point X (the point of intersection) where the directions of supplied air intersect with each other is set at a position corresponding to the leading end of the sheet P discharged into the shift tray 202, it is possible to ensure that the air layer AL is formed over the entire area of the discharged sheet P in its longitudinal direction. Thus, the advantage described in the above 1) can be produced more effectively.

6) The blower 400 includes the louver 421 that sets the direction of supplied air toward the central part of the shift tray 202 in the sheet width direction; thus, it is possible to define the direction of the air W by using a simple configuration.

7) There are provided the pair of discharge rollers 6 that discharges the sheet P through the discharge port 6*c*; the shift tray 202 that has the discharged sheet P stacked thereon; and the blower 400 that supplies air toward the lower surface of the sheet P while the sheet P is discharged, the air being supplied in a direction that is not toward the sheet stack surface 202*b* of the shift tray 202; thus, the air W can be supplied toward the lower surface of the sheet P. Accordingly, it is possible to form the sufficient air layer AL that covers the leading edge PH of the discharged sheet P; thus, the sheet P can be surely prevented from adhering or being bent, and the desirable alignment accuracy can be obtained.

8) The direction that is not toward the sheet stack surface 202*b* of the shift tray 202 is a direction parallel to the sheet stack surface 202*b*; therefore, it is possible to ensure that the air layer AL parallel to the sheet stack surface 202*b* is formed on the side of the lower surface of the sheet P. Thus, the advantage described in 6) can be produced.

9) The blower 400 includes the duct 412 that sets the direction of supplied air toward the direction that is not toward the sheet stack surface 202*b* of the shift tray 202; thus, when air is supplied by the blower 400, the air flow (the air W) parallel to the sheet stack surface 202*b* can be formed.

10) As the CPU 101 (a setting unit) that sets the wind speed of air supplied by the blower 400 is provided, it is possible to appropriately control the wind speed depending on the type of sheet P or the size of the sheet P.

11) If the CPU 101 sets the wind speed in accordance with sheet type information, it is possible to effectively form the air layer AL depending on the type of sheet P to be stacked, such as a regular sheet, coated sheet, or tracing sheet.

12) if the CPU 101 makes a setting as to whether air is to be supplied in accordance with sheet type information, it is possible to prevent unnecessary blowing operations for regular sheets for which blowing is not necessary as default. Thus, a waste of electricity can be prevented.

13) if the CPU 101 makes a setting in response to an input of a user's operation via the operation panel 105, a user can make a setting as he/she intends.

A discharge port set forth in the claims corresponds to the reference numeral 6*a* in the present embodiment, a sheet corresponds to the reference codes P, P1 (the leading sheet), and P2 (the subsequent sheet), a discharge unit corresponds to the pair of discharge rollers 6, a stack unit corresponds to the shift tray 202, a blowing unit corresponds to the blower 400, the direction of supplied air corresponds to the direction of the air W, an intersection point corresponds to the intersection point X, a louver corresponds to the reference numeral 421, a duct corresponds to the reference numeral 412, a setting unit corresponds to the CPU 101, an operating unit corresponds to the operation panel 105, a sheet discharge apparatus corresponds to the sheet post-handling apparatus PD, and an image forming system corresponds to the system that includes the image forming apparatus PR and the sheet post-handling apparatus PD.

According to an aspect of the present invention, it is possible to ensure that sheet adhesion or bending can be prevented and desired alignment accuracy can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet stacking apparatus comprising:

a discharge unit configured to discharge a sheet through a discharge port;

a stack unit having a sheet stack surface that inclines in a sheet discharge direction that is configured to stack the discharged sheet thereon; and a plurality of blowing units configured to supply air to a discharge side of the discharge unit while the sheet is discharged, each of the plurality of blowing units having a blowing duct, each of the blowing ducts being on a side of the discharge port and having a same angle as that of the sheet stack surface with respect to a horizontal direction, wherein each of the plurality of blowing units include a blower opening and each blower opening is disposed below the discharge port, and wherein directions of air supplied by the plurality of blowing units at two ends are set such that the directions intersect with each other above the stack unit.

2. The sheet stacking apparatus according to claim 1, wherein the blowing ducts are located laterally outside of the discharge unit and the plurality of blowing units are provided at both ends of the stack unit in the direction perpendicular to the sheet discharge direction.

3. The sheet stacking apparatus according to claim 1, wherein a position where the directions intersect with each other is set at a central part of the stack unit in a width direction.

4. The sheet stacking apparatus according to claim 1, wherein a position where the directions intersect with each other is set at a position corresponding to a leading end of a sheet that is discharged into the stack unit.

5. The sheet stacking apparatus according to claim 1, wherein the plurality of blowing units includes a louver that sets a direction of supplied air toward a central part of the stack unit in a sheet width direction.

6. The sheet stacking apparatus according claim 1, further comprising a setting unit configured to set a wind speed of air supplied by the plurality of blowing units.

7. The sheet stacking apparatus according to claim 6, wherein the setting unit sets the wind speed in accordance with sheet type information.

8. The sheet stacking apparatus according to claim 6, wherein the setting unit makes a setting as to whether air is to be supplied in accordance with sheet type information.

9. The sheet stacking apparatus according to claim 6, wherein the setting unit makes the setting in response to an input of a user's operation via an operating unit.

10. An image forming system comprising the sheet stacking apparatus according to claim 1.

11. A sheet stacking apparatus comprising:

a discharge unit configured to discharge a sheet through a discharge port;

a stack unit having a sheet stack surface that inclines in a sheet discharge direction that is configured to stack the discharged sheet thereon; and a plurality of blowing units configured to supply air toward a lower surface of the sheet that is being discharged, each of the plurality of blowing unit having a blowing duct on a side of the discharge port and having a same angle as that of the sheet stack surface with respect to a horizontal direction, the air being supplied in a direction that is not toward the sheet stack surface of the stack unit, wherein the discharge port opens directly onto the stack unit.

12. The sheet stacking apparatus according to claim 11, wherein the direction that is not toward the sheet stack surface of the stack unit is a direction parallel to the sheet stack surface.

13. The sheet stacking apparatus according to claim 11, wherein each of the blowing ducts sets a direction of supplied air toward a direction that is not toward the sheet stack surface of the stack unit.

14. The sheet stacking apparatus according claim 11, further comprising a setting unit configured to set a wind speed of air supplied by the blowing unit.

15. The sheet stacking apparatus according to claim 14, wherein the setting unit sets the wind speed in accordance with sheet type information.

16. The sheet stacking apparatus according to claim 14, wherein the setting unit makes a setting as to whether air is to be supplied in accordance with sheet type information.

17. The sheet stacking apparatus according to claim 14, wherein the setting unit makes the setting in response to an input of a user's operation via an operating unit.

18. An image forming system comprising the sheet stacking apparatus according to claim 11.

19. A sheet stacking method comprising:

discharging, by a discharge unit, a sheet through a discharge port;

stacking, on a stack unit having a sheet stack surface that inclines in a sheet discharge direction that is, the sheet discharged by the discharge unit; and supplying air to a discharge side while the sheet is discharged by using a plurality of blowing units, each of the plurality of blowing units having a blowing duct, each of the blowing ducts being on a side of the discharge port and having a same angle as that of the sheet stack surface with respect to a horizontal direction, each of the plurality of blowing units located below the discharge port.

* * * * *